United States Patent [19]

Davis

[11] 4,160,977

[45] Jul. 10, 1979

[54] AUTOMOBILE ANTENNA

[76] Inventor: Ross A. Davis, 95-461 Kaulia Pl., Mililani Town, Hi. 96789

[21] Appl. No.: 880,716

[22] Filed: Feb. 23, 1978

[51] Int. Cl.[2] ..... H01Q 1/32

[52] U.S. Cl. ..... 343/713; 343/711

[58] Field of Search ..... 343/704, 711, 712, 713

[56] References Cited

U.S. PATENT DOCUMENTS

| | | | |
|---|---|---|---|
| 2,923,813 | 2/1960 | Davis | 343/712 |
| 3,066,293 | 11/1962 | Davis | 343/712 |
| 3,771,159 | 11/1973 | Kawaguchi et al. | 343/713 |
| 3,845,489 | 10/1974 | Sauer et al. | 343/713 |
| 4,003,056 | 1/1977 | Davis | 343/713 |

*Primary Examiner*—Alfred E. Smith
*Assistant Examiner*—Harry E. Barlow
*Attorney, Agent, or Firm*—Bruce L. Birchard

[57] ABSTRACT

By forcing the resonance in the medium-wave spectrum of the electromagnetic loop antenna or antennas formed by a shunting conductor in combination with a series connected capacitor shunting a window opening in an automobile body and coupling to an output conductor through the distributed capacitance and mutual inductance provided by close physical proximity between such output conductor and such shunting conductor, such output conductor terminating at one end in at least one antenna element having electrostatic antenna characteristics, an output signal from the antenna is obtained which exhibits the electrostatic-noise rejection characteristics of a loop antenna and the omni-directional characteristics of a vertical whip-type antenna, while, at the same time, the impedance of the system is compatible with standard radio-tuner input circuits.

10 Claims, 5 Drawing Figures

AUTOMOBILE ANTENNA

BACKGROUND OF THE INVENTION

1. Field of the Invention

This invention relates to the field of radio antennas, and, more specifically, to conductive-body-loop antennas.

2. Prior Art

The prior art patents believed by applicant to be most pertinent to his present invention are as follows:

U.S. Pat. No. 3,845,489 (Sauer, et al).
U.S. Pat. No. 3,771,159 (Kawaguchi, et al).
U.S. Pat. No. 3,717,876 (Volkers, et al).
U.S. Pat. No. 3,810,180 (Kunert, et al).
U.S. Pat. No. 4,003,056 (Davis).

Probably the closest prior art is set forth in FIG. 9 of U.S. Pat. No. 4,003,056 which was issued to me on Jan. 11, 1977. In that embodiment the body opening is resonated at medium wavelengths by condensers 144 and 146. Conductors 128 and 134 act as electrostatic signal pick-up devices at medium wavelengths. Thus a hybrid antenna system is provided. However, because the output coaxial cable is connected, for r.f. purposes, directly across the window opening it "sees" the extremely low impedance represented by the series resonated loop and is heavily loaded by that low impedance, as is the input transformer of the associated radio tuner. Such loading (or impedance mis-matching) results in undesired signal losses and consequent insensitivity of the antenna system.

Therefore it is a general object of this invention to correct the problems and disadvantages set forth hereinbefore.

It is another object of this invention to provide an improved antenna system which exhibits low electrostatic noise sensitivity, high signal sensitivity, omnidirectionality and easily matched output impedance.

SUMMARY OF THE INVENTION

A metallic body, such as an automobile body, having an opening therein is caused to resonate at medium-wave radio frequencies by at least one series-connected electrical conductor-resonating condenser combination shunted across the opening. The r.f. currents flowing in such electrical conductor are coupled, capacitively, and inductively, to an output conductor which simultaneously, by reason of an extension thereof, acts as an electrostatic antenna of moderate impedance. The capacitive coupling is a result of distributed capacitance between the bundled conductors traversing the body opening. The inductive coupling is a result of the mutual inductance existing between the closely proximate conductors. The impedance presented to the output coaxial cable and to the radio tuner is such as to make the transfer of r.f. energy efficient and to provide proper phasing of the electrostatic and electromagnetic signal components in the total signal presented to associated radio receiving apparatus.

BRIEF DESCRIPTION OF THE DRAWINGS

My invention may be better understood by referring to the following detailed description and accompanying drawings, in which.

DETAILED DESCRIPTION OF THE PREFERRED EMBODIMENT

Figure 1:
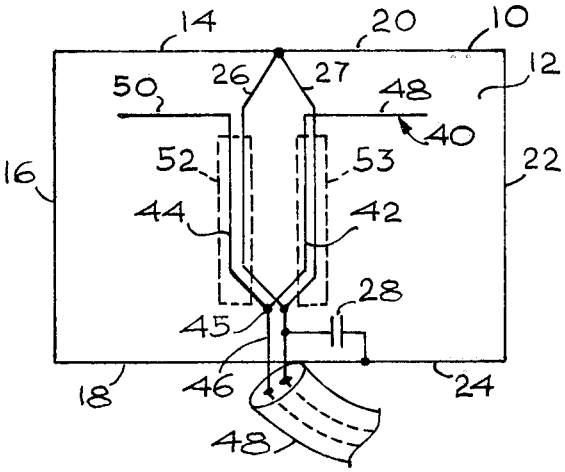
FIG. 1 is a schematic diagram of a first embodiment of my invention.

Conductive edge 10 of opening 12, which opening may be a window in an automobile, is made up of segments 14, 16, 18, 20, 22 and 24. Segments 14 and 20 and 18 and 24, respectively, may be of the same length.

Conductors 26 and 27, in combination with condenser 28, span opening 12 and resonate the loop antenna comprising segments 14, 16, 18, 20, 22 and 24. As a result, relatively strong r.f. currents flow through conductors 26 and 27.

Electrostatic antenna 40 comprises vertical elements 42 and 44 terminating at one end in a common connection 45 to inner conductor 46 of shielded output cable 48. At the opposite ends conductors 42 ad 44 terminate in horizontal elements 48 and 50, respectively.

Conductors 26, 44 and 42, 27, respectively are held in contiguous relationship with each other by sheaths 52 and 53, which may be in the form of a pressure sensitive tape. As a result of the contiguous relationship of the recited conductors there is significant distributed capacitance and mutual inductance (and, consequently, signal coupling) from conductor 26 and 27 into conductors 44 and 42, respectively. At the same time, r.f. signals picked up directly by horizontal elements 48 and 50, acting as elements of an electrostatic antenna, appear at output conductor 46, in aiding phase relationship with the signals sensed by the series-resonated loops. Thus a strong, relatively omni-directional r.f. signal is derived from the system when it is exposed to an electromagnetic field in the medium-wave radio spectrum.

Figure 2A:
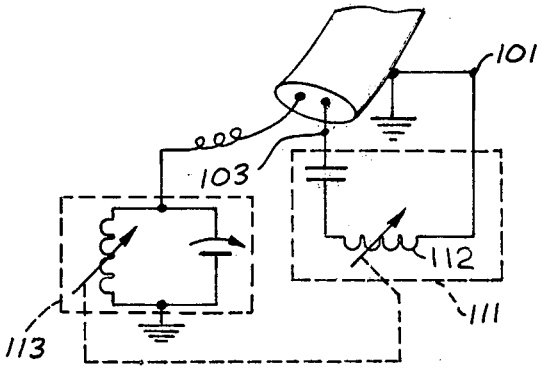
FIG. 2A is a schematic diagram of an alternative loop resonating circuit for use with this invention.
Figure 2:
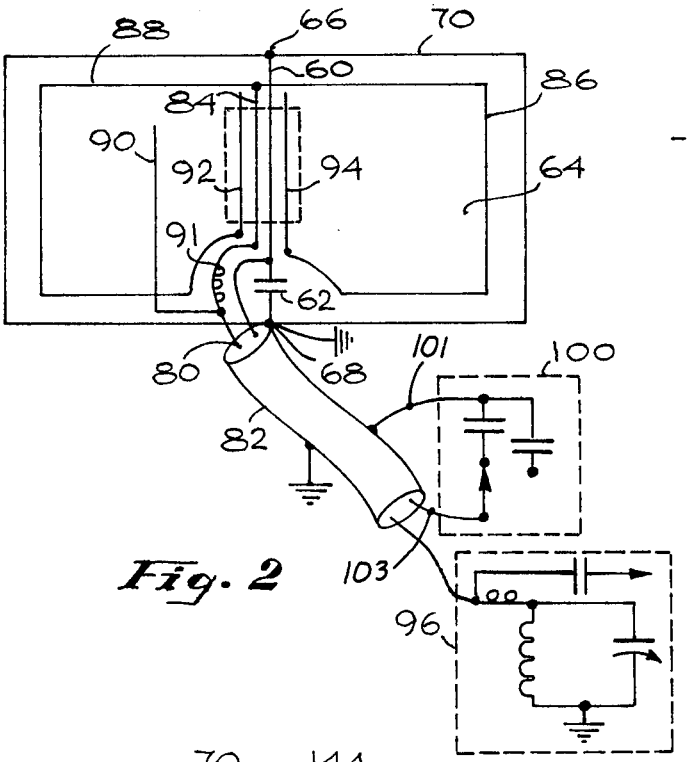
FIG. 2 is a schematic diagram of a second embodiment of my invention.

In FIG. 2, conductor 60 (which is, preferably No. 26 A.W.G. or larger) in series connection with condenser 62, is shunted across window opening 64, the combination being electrically connected at its opposite ends to points 66 and 68 on conductive window edge 70. Condenser 62 may have a value of about 0.008 mfd., which will resonate the body loop it forms with edge 70 at the high end of the U.S. broadcast band (1550 Khz) for a windshield in a U.S. manufactured automobile. Strong r.f. currents over the broadcast, or medium wave, band will flow in conductor 60.

Conductor 80 of shielded cable 82 is connected to vertical antenna conductor 84 which joins two ostensibly open loops 86 and 88, the latter each comprising 1 to 6 turns of fine wire, say 40 gauge. Segment 92 of loop 88 and segments 94 of loop 86 are bundled together with conductor 60 (carrying loop antenna currents) and central conductor 84. There results in central conductor 84 an in-phase combinaton of body loop and electrostatic antenna signals. Further, the impedance looking into central conductor 84 as seen through cable 82 is compatible with normal autoradio receiver input stages, such as stage 96.

To maximize signal strength at selected points across the medium-wave spectrum, step-variable condenser combination 100 is provided. It is shunted across condenser 62 through cable 82.

To permit reception of radio signals in the U.S. F-M spectrum (88–108 MHz) antenna element 90 is provided. It is connected to output conductor 80 but is isolated from loops 86 to 88, at F-M frequencies, by choke coil 91. Experiments have shown that element 90 should be approximately 22 inches long and spaced from the central conductor 84 by about 3 inches for optimum F-M reception.

FIG. 2A shows an alternative circuit for resonating the loops 86 and 88 of FIG. 2. Instead of the step-condenser circuit 100 of FIG. 2 a series fixed capacitance-slug-tuned inductance circuit 111 is provided. To substitute circuit 111 for circuit 100 is merely a matter of disconnecting circuit 100 at junctions 101 and 103 and connecting circuit 111 to those junctions, as is shown in FIG. 2A. The inductance-varying element in inductance 112 is maehanically linked to the inductance varying element in the radio r.f. tuner 113 so that, as the inductance value of the variable inductive tuner 110 is increased, the magnitude of inductance 112 is decreased, increasing the effective capacitive reactance in the loop-resonating circuit and tuning the two loops formed with edge 70 by conductor 60 and condenser 62, to resonance at a lower frequency.

Figure 2B:
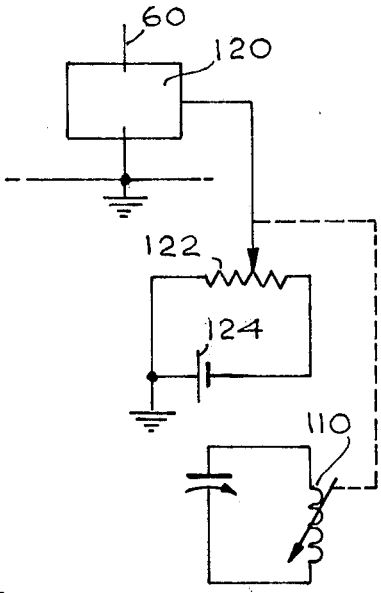
FIG. 2B is a schematic diagram of another antenna resonating circuit.

In FIG. 2B, element 120 is an electrically variable capacitance (sometimes referred to as a "varicap" and available from several manufacturers) which may be located at the edge of opening 64 and may take the place of condenser 62 in FIG. 2. A variable resistor 122 ganged with radio tuning inductor 110 is connected across power source 124 and provides a variable voltage to variable capacitor 120, to resonate the loops formed by conductor 60 and condenser 62 shunting opening 64 at the frequency to which the associated radio is tuned.

Figure 3:
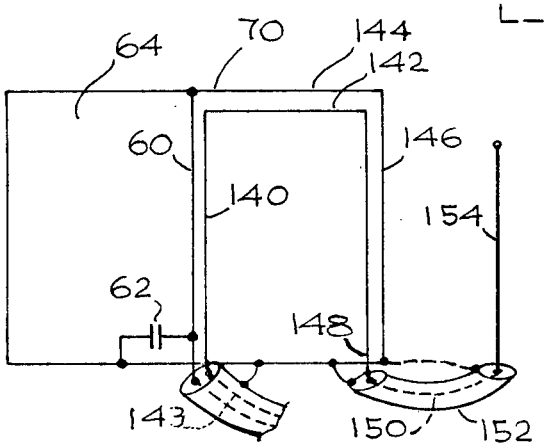
FIG. 3 is a schematic diagram of a simplified antenna according to this invention.

In FIG. 3, conductive edge 70 of opening 64 is shunted, at substantially its mid-point, by conductor 60 and condenser 62 to form two body-loop antenna elements. An additional vertical element 140, connected to output conductor 143, is placed in close proximity to conductor 60. A continuation 142 of element 140 is placed about 2 inches from edge portion 144 of edge 70 and further continues along edge portion 146, being connected at its extremity 148 to inner conductor 150 of coaxial cable 152. Conductor 152 is connected to a conventional whip antenna 154, which may be mounted in the cowling or elsewhere in the associated vehicle.

While particular embodiments of my invention have been shown and described it will be apparent to those skilled in the art that various modifications may be made to those embodiments without departing from the spirit and scope of my invention. The appended claims are intended to cover any and all such embodiments.

I claim:

1. A vehicle antenna system responsive to both electrostatic and electromagnetic components of a radio signal and presenting an optimum impedance to associated radio circuits, including:

an electrically conductive vehicle body having at least one window opening therein to form a conductive edge;

a first conductor series connected with a first condenser to form a first tuning combination, said first tuning combination being electrically coupled between oppositely disposed points along said conductive edge, said condenser having a magnitude of capacitance sufficient to produce in the medium wavelength radio band electrical resonance of a body loop including at least a portion of said conductive edge;

a plurality of intercoupled, electrically conductive members serially disposed on said window to form at least one antenna element primarily responsive to the electrostatic component of an impinging radio wave;

at least one of said plurality of intercoupled, electrically conductive members being physically closely proximate to said first conductor and parallel thereto but conductively isolated therefrom, whereby capacitive and inductive coupling of radio signals between said first conductor and said at least one of said plurality of intercoupled, electrically conductive members, occurs;

and an output conductor coupled to one of said at least one of a plurality of intercoupled, electrically conductive members proximate to said first conductor.

2. Apparatus according to claim 1 in which said plurality of intercoupled, electrically conductive members forms a conductively open loop.

3. Apparatus according to claim 2 in which said conductively open loop is proximate to said conductive edge and to said first conductor and is inductively and capacitively coupled to both of them.

4. Apparatus according to claim 1 in which said plurality of intercoupled, electrically conductive members forms a pair of conductively open loops each connected at one end to a common conductor which, in turn, is connected to said output conductor.

5. Apparatus according to claim 1 in which said condenser is electrically variable in value.

6. Apparatus according to claim 5 in which variable electrical means ganged with external radio tuning apparatus are provided to apply an electrical parameter of variable magnitude to said condenser.

7. Apparatus according to claim 1 which includes, in addition, an external, variable, loop-tuning capacitor circuit coupled to said first conductor.

8. Apparatus according to claim 1 which includes, in addition, bundling means for holding said first conductor and said at least one of a plurality of said intercoupled, electrically conductive members in close proximity to each other.

9. Apparatus according to claim 8 in which said bundling means is a pressure-sensitive plastic tape.

10. Apparatus according to claim 1 in which said plurality of intercoupled, electrically conductive members are of 40 gauge wire.

* * * * *